US009707773B1

(12) United States Patent
Roginski et al.

(10) Patent No.: US 9,707,773 B1
(45) Date of Patent: Jul. 18, 2017

(54) APPARATUS FOR DELIVERING INK TO INK JET PRINT HEADS

(71) Applicant: inc.jet Inc., Norwich, CT (US)

(72) Inventors: Zbigniew Roginski, Rocky Hill, CT (US); Daniel Cavaliere, Sterling, CT (US)

(73) Assignee: inc.jet, Inc., Norwich, CT (US)

( * ) Notice: Subject to any disclaimer, the term of this patent is extended or adjusted under 35 U.S.C. 154(b) by 0 days.

(21) Appl. No.: 15/070,280

(22) Filed: Mar. 15, 2016

(51) Int. Cl.
*B41J 2/175* (2006.01)

(52) U.S. Cl.
CPC ..... *B41J 2/17596* (2013.01); *B41J 2/175* (2013.01); *B41J 2/17556* (2013.01); *B41J 2002/17516* (2013.01)

(58) Field of Classification Search
CPC ..... B41J 2/175; B41J 2002/17516; B41J 2/17556; B41J 2/17596
See application file for complete search history.

(56) References Cited

U.S. PATENT DOCUMENTS

2015/0097900 A1* 4/2015 Araki ..... B41J 2/17566 347/85

* cited by examiner

*Primary Examiner* — Julian Huffman
(74) *Attorney, Agent, or Firm* — Baker & McKenzie LLP

(57) ABSTRACT

An imaging device and associated circuit assembly for depositing ink onto moving media. The imaging device is flexible in that it allows the configuration of pens in a variety of ways to enable a user to increase the speed with which printing can be accomplished, vary the colors used in printing, change the orientation of the printing on the media, and/or print at multiple locations at the same time.

11 Claims, 3 Drawing Sheets

APPARATUS FOR DELIVERING INK TO INK JET PRINT HEADS

BACKGROUND AND SUMMARY

The present invention relates to printers, and more specifically to a system for delivering ink to an ink jet print head. Unlike other systems, this system can measure and control the pressure of ink in a reservoir that is directly connected (that is, without tubes) to the print head. The direct connection ensures that there are no additional pressure swings at the print head, which is important because the pressure needed for proper meniscus control is a very small, slightly negative pressure, and should preferably be measured and controlled in about 30 ms.

Some other ink jet systems maintain pressure by measuring the pressure of air that is in fluid communication with the ink near the print head, or they rely on a combination of ink or air pressure and keep the ink reservoir at a fixed height relative to the print head. In whatever combination that might be used in such systems, there are problems associated with having the ink exposed to air in the system, and with the necessity of maintaining a fixed height of the ink column above or below the print head.

BRIEF DESCRIPTION OF THE DRAWINGS

These and other features, aspects, objects, and advantages of the inventions described and claimed herein will become better understood upon consideration of the following detailed description, appended claims, and accompanying drawings where:

It should be understood that the drawings are not necessarily to scale and that the embodiments are sometimes illustrated by graphic symbols, phantom lines, diagrammatic representations and fragmentary views. In certain instances, details which are not necessary for an understanding of the inventions described and claimed herein or which render other details difficult to perceive may have been omitted. It should be understood, of course, that the inventions described herein are not necessarily limited to the particular embodiments illustrated.

DETAILED DESCRIPTION OF THE DRAWINGS

Figure 1:
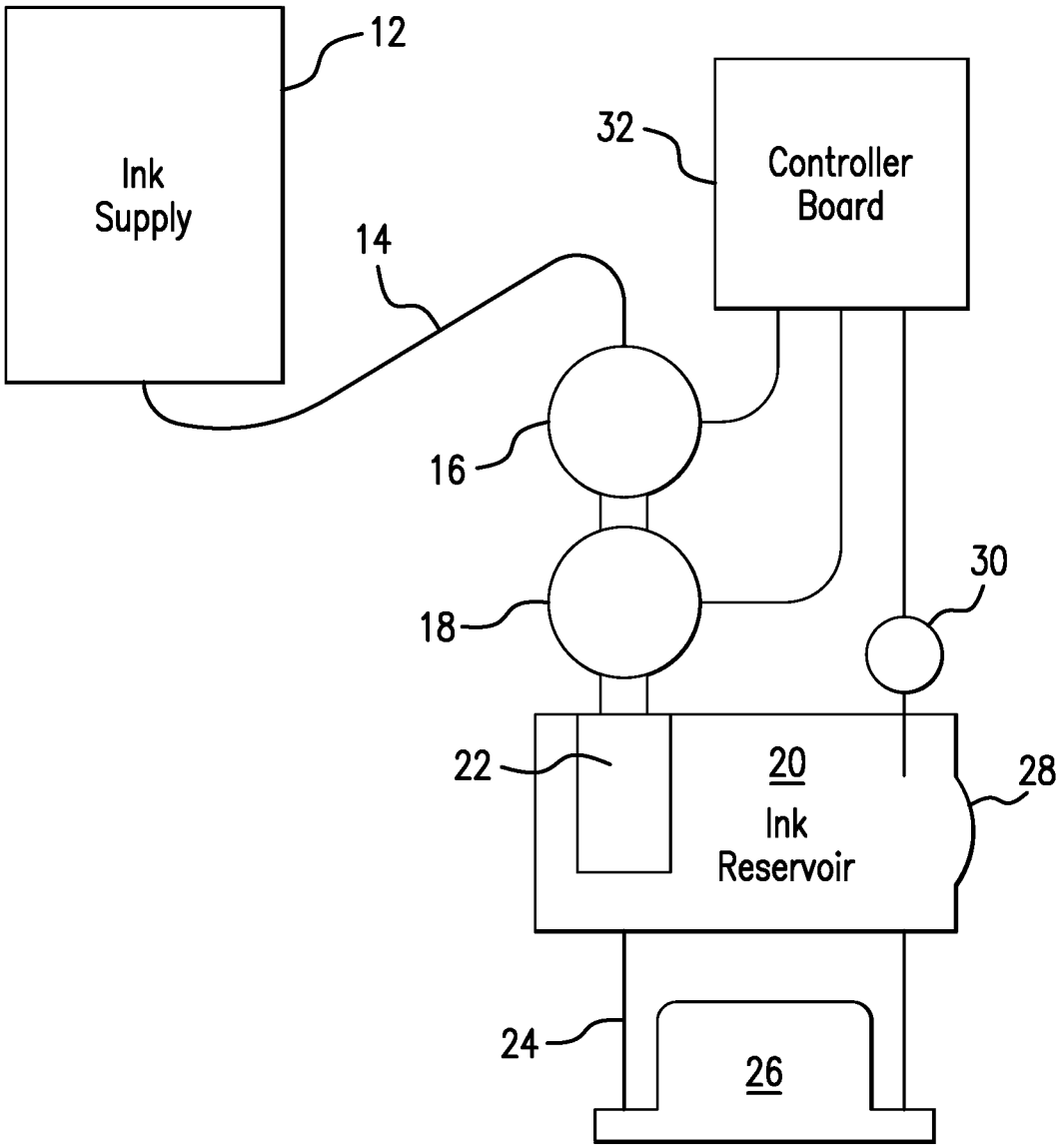
FIG. 1 is a functional diagram of an exemplary embodiment of the ink delivery system described herein.

FIG. 1 shows an example of an exemplary ink delivery system 10. The system comprises an ink supply 12 connected by (for example) tubing 14 to solenoid valve 16. Solenoid valve 16 in turn is connected to pump 18, whose output is connected to ink reservoir 20 through ink filter 22, which is a "last chance" ink filter within the ink reservoir 20. Pump 18 may be a solenoid micro pump, which is self-priming and can accurately dispense very low, fixed volumes of ink when cycled.

It may be possible to eliminate valve 16 if, for example, pump 18 does not allow flow when it is not actuated. Otherwise, valve 16 is closed when there is no demand for ink in order to maintain the total volume of ink in the reservoir, which in turn determines the pressure. The ink reservoir 20 is integrally connected (without tubing) to manifold 24, which is connected directly to the print head 26. Alternatively, the reservoir may be directly connected to the print head. As with the reservoir-to-manifold connection, the connection of the manifold to the print head's ink ports is preferably made without tubing, the manifold being designed for an exact fit to the print head's ink ports. The absence of tubing between the reservoir, manifold, and print head reduces rapid pressure changes and the chance of air entering the system.

The ink reservoir 20 preferably includes a spring-loaded diaphragm 28. The spring applies a bias or force to the diaphragm during operation. This diaphragm 28 helps to maintain constant pressure at the print head 26 by preventing instantaneous pressure changes in the reservoir (and, correspondingly, at the print head) as ink flows. The system has a substantially constant volume of ink between at least the valve and the print head, although the volume can change slightly due to movement of the diaphragm. A pressure sensor 30 may also be connected to reservoir 20 to monitor the pressure of ink in the reservoir 20. The valve 16, pump 18, and pressure sensor 30 can all be connected to a controller board 32 to maintain the desired pressure in the reservoir and, correspondingly, the ink ports on print head 26. In addition to other system functions, for purposes of the exemplary embodiment, the controller board is typically a printed circuit board with interfaces for reading the output of pressure sensor 30, opening and closing valve 16, and running or "cycling" pump 18 in order to maintain a desired pressure at sensor 30, as will be described further below. Typically, a pump such as pump 18 may be driven with a DC voltage, such as 12 or 24 VDC, and is run by providing on and off voltages in cycles.

Figure 2:
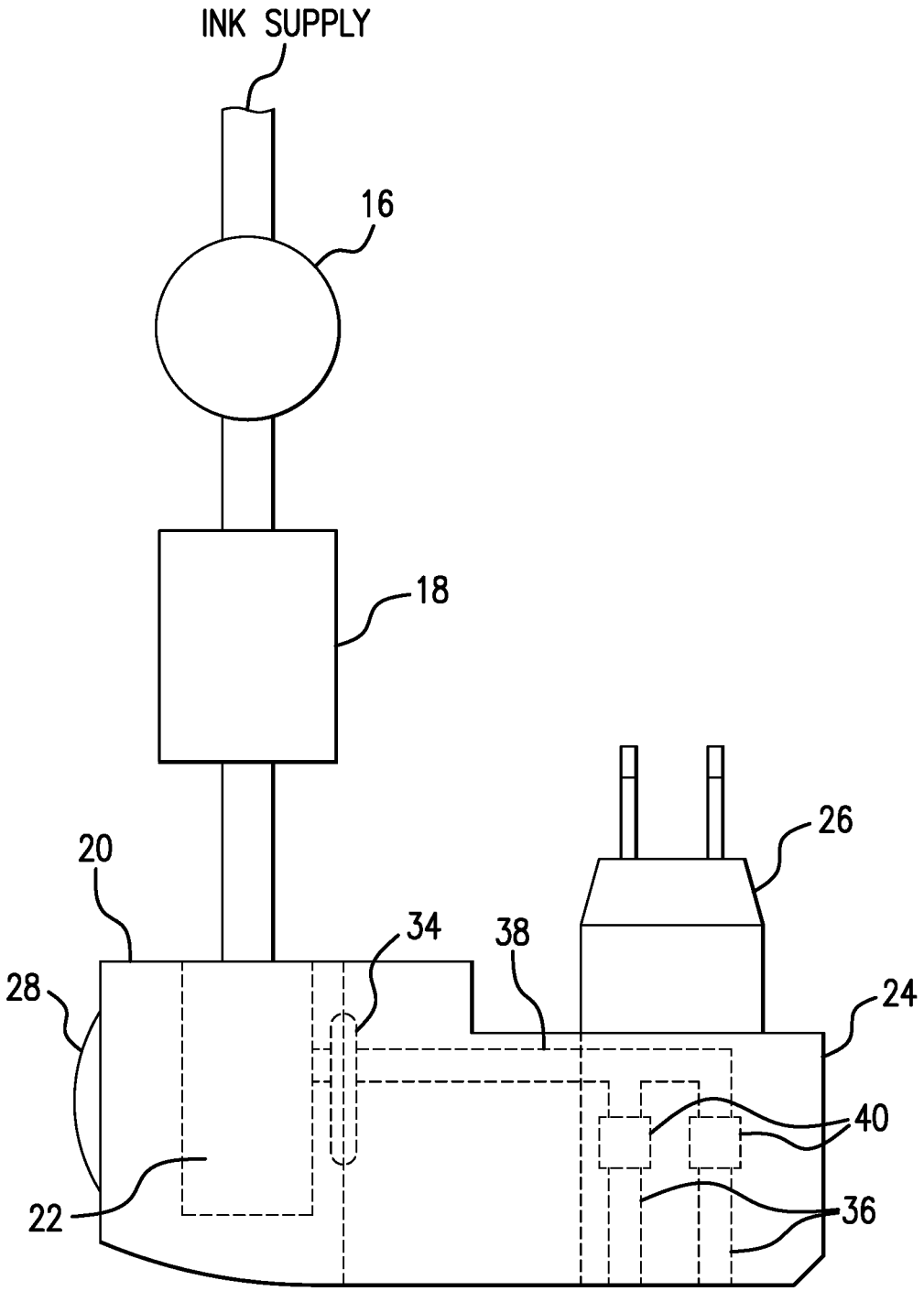
FIG. 2 is a side view of a portion of an exemplary embodiment of the ink delivery system described herein.
Figure 3:
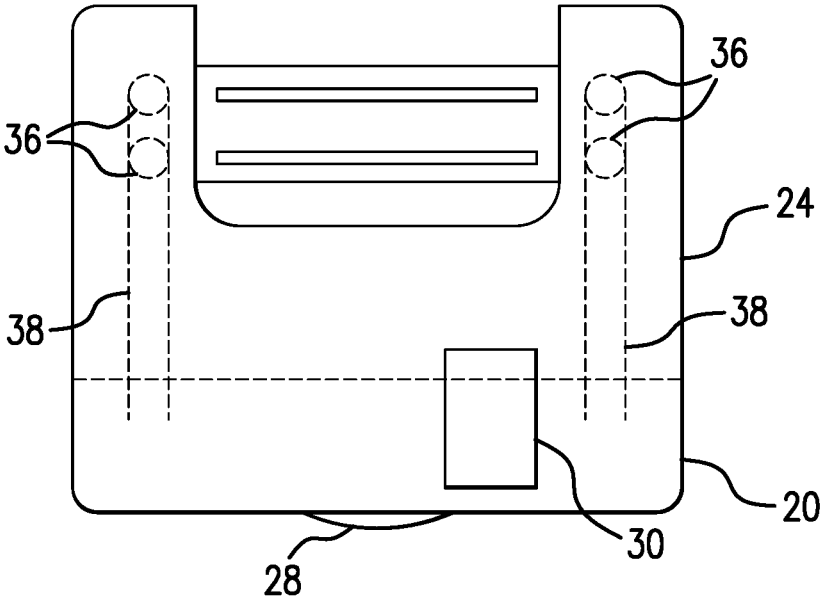
FIG. 3 is a top view of a portion of an exemplary embodiment of the ink delivery system described herein.

Because the relative positions of components in the present system may distinguish it from prior art systems, FIGS. 2 and 3 illustrate the positions of components in an exemplary embodiment. It should be noted that the following descriptions are made with reference to the positions as shown, but are not absolute because as noted, the system may advantageously be used to print in orientations not possible or practical for other systems.

FIG. 2 illustrates an exemplary embodiment that includes valve 16, pump 18, reservoir 20, diaphragm 28, manifold 24, print head 26, and ink ports 36. For clarity, the pressure sensor 30 is not shown, but is shown in FIG. 3. The pressure sensor is mounted to the top of reservoir 20, with the actual sensor element in fluid communication with the reservoir 20. Reservoir 20 is coupled to integral manifold 24, and may be sealed with seal 34. The dashed line 38 illustrates the fluid path from the reservoir 20 to the manifold 24. In the exemplary embodiment, the print head 26 has 2 ink ports 36 on each side. Also in the exemplary embodiment, all 4 ink ports are in fluid communication with the manifold and reservoir, although other configurations are possible, for example, for color printing where different colors of ink are supplied to the ink ports. The manifold is designed so that the print head 26 can be connected to it using seals 40 without the use of tubing.

FIG. 3 is a top view of an exemplary embodiment of the system. For purposes of clarity, valve 16 and pump 18 are not shown. As shown, manifold 24 is in a "U" configuration so that it may simultaneously supply all 4 ink ports 36 with ink in this embodiment. As in FIG. 2, it can be seen that manifold 24 and reservoir 20 are in fluid communication, with the ink paths outlined by dashed lines 38. Pressure sensor 30 is mounted on top of reservoir 20, so it can directly monitor the pressure of ink in the reservoir.

Operation

As mentioned above, the present system differs from some prior art systems by, among other things, operating without air. Systems that operate with air in the ink path can be problematic because the air and ink should be separate from each other. In the exemplary embodiment of the present system, a slight negative pressure can be very precisely maintained at the ink reservoir and print head without regard to gravity. In at least some conventional systems, the ink supply must be positioned slightly below the level of the print head nozzle to prevent siphoning and to maintain the required negative pressure. This limits the ability to use the system in modes where the print head is horizontal, or other positions. In addition, in some prior art systems, pressure is maintained by controlling the pressure of the air in the system, and replacing air when pressure is to be increased. These systems may be problematic, due to air mixing with ink, and also because air pressure measurement systems must not come in contact with ink. The need to prevent ink contact with an air pressure sensor may also limit the ability to print in orientations where the print head is not facing down.

When the system 10 is first used, the system may be put into a power purge state by a user, for example by pushing a button that opens valve 16 and runs pump 18 until all the air is pushed out and de-gassed ink is in the system from the ink supply 12 all the way to print head 26. Once printing starts, the print head's demand for ink will create an increasingly negative pressure in the reservoir as long as valve 16 is closed and pump 18 is not running. The reservoir pressure changes because the system has a substantially fixed volume and does not have entrained air.

The system may, for example, maintain ink pressure in the reservoir at between −2" and −4" of water, although different pressures may be used as needed, depending on the system components and the desired meniscus position. This should preferably be done in about 30 ms or less. For example, if a starting pressure of −2" of water is present at the pressure sensor 30, the controller board 32 may be configured to monitor pressure substantially constantly until it decreases to a given point, for example, −4" of water. At that point, the controller board can send appropriate signals to open valve 16 and cycle pump 18 until the ink pressure is restored to −2" as measured by the pressure sensor. This can be accomplished very rapidly and precisely because pump 18 is a fast pump whose output volume can either be fixed or accurately controlled for each cycle.

Once the ink pressure has returned to the desired set point (−2" of water in the example), the valve 16 is closed and the pump 18 is not driven until needed again, at which time the process repeats.

The pump/valve/filter/diaphragm system described here is capable of replacing ink in the manifold reservoir in the same amount that is used by the print head in real time or substantially real time. It does so smoothly and quickly enough to maintain a stable set negative pressure with variations small enough to meet the pressure range requirements of the print head. Ink injection by the system is smooth enough so that it does not cause individual print head nozzles to de-prime or to operate in an unsatisfactory manner. Accordingly, the ink injection system will always maintain a supply of ink to the ink manifold so that it is always filled to the desired level within acceptable tolerances. Pressure spikes and dips are kept within acceptable levels.

While the invention has been described with reference to particular embodiments which has been shown in the figures and discussed above, it will be apparent to those skilled in the art that numerous variations, modifications and improvements may be made to the invention described herein without departing from the spirit and scope of the appended claims.

We claim:

1. A system for delivering ink to a print head, comprising:

a positive-displacement, electrically-operated pump connectable between an ink supply and a print head;

an ink reservoir fluidly connectable between the output of the pump and the print head, wherein the ink reservoir and a first ink path between the output of the pump and the reservoir are designed to be substantially free of air during operation;

a manifold coupled directly to the reservoir and being directly connectable to the print head without the use of tubing, wherein a second ink path between the reservoir and the print head is designed to be substantially free of air during operation, wherein the second ink path includes the manifold;

a biased diaphragm connected between the output of the pump and the print head to reduce pressure swings of the ink in the reservoir; and a pressure sensor connected to sense the fluid pressure of the ink between the pump output and the print head;

wherein a volume of ink between the pump and the print head is substantially constant and free of air so that the use of ink by the print head can create a negative fluid pressure on the ink between the pump and the print head.

2. The system of claim 1, further comprising:

an electrically-operated valve connected between the ink supply and the reservoir.

3. The system of claim 2, wherein the electrically-operated valve is connected between the ink supply and the pump.

4. The system of claim 2, wherein the electrically-operated valve is connected between the ink supply and the pump, and wherein the diaphragm is biased by a spring.

5. The system of claim 4, further comprising a controller, wherein the controller is coupled to at least the pump and the pressure sensor and receives input from the pressure sensor and sends an output to the pump to maintain a substantially constant negative pressure of ink at the pressure sensor's location.

6. The system of claim 5, wherein the controller is further coupled to the electrically-operated valve and controls the electrically-operated valve to allow ink to flow when the pump is running and to prevent ink from flowing once the substantially constant negative pressure of ink is reached.

7. The system of claim 6, further comprising an ink filter in fluid connection between the pump and the ink reservoir.

8. The system of claim 7, wherein the substantially constant negative pressure is between about −2 and −4 inches of water.

9. The system of claim 8, wherein the substantially constant negative pressure creates a substantially constant negative pressure at the print head that is between about −2 and −4 inches of water regardless of the orientation of the print head relative to the reservoir and manifold.

10. The system of claim 1, wherein the diaphragm is biased by a spring.

11. The system of claim 1, further comprising a controller, wherein the controller is coupled to at least the pump and the pressure sensor and receives an input from the pressure sensor and controls the pump based on the input to maintain a substantially constant negative pressure of ink at the pressure sensor's location.

* * * * *